US007967040B1

(12) United States Patent
Sanford

(10) Patent No.: US 7,967,040 B1
(45) Date of Patent: Jun. 28, 2011

(54) SYSTEM FOR TRANSFERRING A VISCOUS LIQUID BETWEEN CONTAINERS

(76) Inventor: Peter B. Sanford, Morro Bay, CA (US)

( * ) Notice: Subject to any disclaimer, the term of this patent is extended or adjusted under 35 U.S.C. 154(b) by 0 days.

(21) Appl. No.: 12/647,428

(22) Filed: Dec. 25, 2009

(51) Int. Cl.
*B65B 1/04* (2006.01)

(52) U.S. Cl. ..... 141/319; 141/332; 141/363; 141/364; 141/365; 141/366; 222/570

(58) Field of Classification Search ..... 141/319, 141/332, 340, 363–366; 222/570
See application file for complete search history.

(56) References Cited

U.S. PATENT DOCUMENTS 3,094,250 A * 6/1963 Molyneaux et al. ..... 222/207
3,201,015 A * 8/1965 Wagaman ..... 222/570
4,034,901 A * 7/1977 Kirk ..... 222/481.5
4,105,142 A * 8/1978 Morris, Jr. ..... 222/158
4,239,130 A * 12/1980 Altadonna ..... 222/131
4,698,861 A * 10/1987 Bogusz ..... 4/654
5,477,873 A * 12/1995 Ramsey et al. ..... 134/155
5,655,580 A * 8/1997 Schrock ..... 141/332
6,065,649 A * 5/2000 Scoggins ..... 222/181.2
6,264,072 B1 * 7/2001 Johannes ..... 222/460
6,418,987 B1 * 7/2002 Colasacco ..... 141/384

* cited by examiner

*Primary Examiner* — Timothy L Maust
(74) *Attorney, Agent, or Firm* — Richard A. Ryan

(57) ABSTRACT

A system for transferring a viscous liquid between containers that comprises a first container from which the liquid is to be drained, a second container for receiving the liquid, a first transfer lid that attaches to the first container, a second transfer lid that attaches to the second container and a transfer adapter that interconnects the lids. The first transfer lid has an outlet spout received into the transfer adapter, which is received in an inlet spout of the second transfer lid. The first container is inverted over the second container to drain liquid from the first container lid to the second container through the connected container lids. In an another configuration, the system is used with bottles and comprises a pair of bottle connectors that each engage a bottle and have interlocking members that join the connectors. In another embodiment liquid is transferred between a bottle and a container.

12 Claims, 11 Drawing Sheets

SYSTEM FOR TRANSFERRING A VISCOUS LIQUID BETWEEN CONTAINERS

BACKGROUND OF THE INVENTION

A. Field of the Invention

The present invention relates generally to systems for transferring liquids from one container to another container. More specifically, the present invention relates to such liquid transferring systems that are particularly useful for transferring a viscous liquid. Even more specifically, this invention relates to viscous liquid transfer systems that facilitate transferring the viscous liquid between containers of the same or different sizes.

B. Background

Many viscous liquids, which include such products as paint, ketchup, mustard, syrup, shampoo and the like, are supplied in bottles, cans, jars or other containers. Most such products are utilized by rotating the container to a position where the top opening is facing downward to allow the product to pour, often very slowly, out of the container. A problem for users of such products is that as the product is used and the container reaches a point where it becomes nearly empty of the product, there is a certain amount of product left in the container that is difficult to utilize because the viscous nature of the product requires the user to wait an unreasonable amount of time for the product to pour out of the container. For many viscous liquid products, the amount of product remaining at this product low point can be somewhat substantial, depending on the viscous nature of the product. If the product at the bottom of the container is not recovered, then it will generally be discarded with the "empty" container. In addition to being a waste of product and, therefore, money, the remaining product in the container can be harmful to the environment. Depending on how the container is disposed, the product remaining in the container can contaminate the soil, groundwater and/or surface waters. In addition, the products can be harmful or even dangerous, particularly when mixed with other disposed products, to those persons who must handle the refuse or who otherwise come into contact with the products(s) in the nominally empty containers.

Some product suppliers attempt to reduce the amount of otherwise unrecoverable product remaining in the container by providing a container that is manufactured out of a material that can be squeezed to force the product from the container. Many users attempt to recover as much product as possible by either storing the container in an upside down condition so the viscous liquid product gathers, due to gravity, near the top of container so as to be ready for use or by heating up the product to make it at somewhat less viscous and easier to pour. Unfortunately, many products are not provided in or suitable for use in containers that are squeezable, cannot be efficiently or conveniently stored in an upside down condition and are unsafe or otherwise unsuitable for being heated to make the product less viscous. Examples of such products include paint that is provided in cans, syrup and like products that can be very messy if not carefully opened after being stored upside down and ketchup, mustard and like products that lose their desired consistency if heated.

Another approach to recovering product remaining in a container is to transfer the product to another container. For a certain amount of the product, the transfer of the product can be accomplished by simply pouring the contents of one container into a second container. As with use of the product, however, a significant amount of viscous liquid product will not easily transfer, such as by pouring, to the second container. In fact, in order to recover substantially all of the remaining product, most viscous liquids would require the user to hold the container in a pouring position above the second container for an unreasonable amount of time. To simplify the process of transferring a viscous fluid from one container to another, users will often place the container to be emptied in an upright or a generally upright position over the container which is to receive the viscous liquid so the liquid will flow from the first container to the second container over time, with the opening of the first container in as close alignment with the opening of the second container to eliminate or at least reduce spillage of the liquid. Although some containers are configured such that they can be placed in a balanced condition above another similarly configured container, for most containers this approach is not practical or even possible without some type of support apparatus or mating device to hold the upside down container in the desired position above the container to receive the viscous liquid.

The prior art discloses a number of different types of devices and systems for transferring viscous liquid from one container to another. For instance, U.S. Pat. No. 7,198,080 to Foust, U.S. Pat. No. 6,182,720 to Barnoski, et al., U.S. Pat. No. 3,877,499 to Fluster and U.S. Pat. No. 3,620,267 to Seablom are representative of devices and systems that are utilized to transfer viscous liquids from a first bottle to a second bottle. Each of these patents, and others related thereto, describe devices and systems wherein the top of the first bottle is placed in a mating relationship with the top of the second bottle with the first bottle inverted over the second bottle to facilitate flow of the viscous liquid from the first bottle. U.S. Pat. No. 4,834,261 to Brdlik discloses a paint storing system for recovering and storing paint that would otherwise be left in a partially emptied paint can. This system utilizes a plastic bag supported in an upright position in a bag holder container and a lid that is secured to the top of the bag holder container and which receives an inverted paint can so paint will flow through a funnel-shaped hole in the lid into the bag, which is then removed from the bag holder container for storage. U.S. Pat. No. 6,539,991 to Ackerman discloses a paint scan spill guard having a downwardly projecting engaging member that engages the channel of the paint can rim and an upwardly disposed funnel-like member. The patent does not disclose a system that allows the user to beneficially transfer a viscous fluid between containers. U.S. Pat. No. 6,706,480 to Saddler, U.S. Publication No. 2008/0053566 to England, U.S. Publication No. 2004/0045631 to White, et al., U.S. Pat. No. 3,899,107 to Gaal and U.S. D576,848 to Williams all disclose container adapters that are received over or inside the container opening and provide a funnel or funnel-like upwardly disposed portion that facilitates pouring liquid from or pouring liquid into the container in a manner that reduces spillage and prevents damage to the rim of the container. None of these patents show a system for beneficially transferring a viscous fluid between containers. U.S. Pat. No. 7,128,230 to Jacobson, et al. and U.S. Pat. No. 2,957,601 to Novick describe lids for containers that facilitate stacking the bottom of one container on the top of another container. The patent to Jacobson also shows use of center aperture through which a beverage may be brewed in the container below when it is used in a beverage brewer. Neither of these patents show the devices being utilized to transfer a viscous liquid from one container to another. Examples of lids having spout or spout-like features for use on paint cans and the like are shown in U.S. Pat. No. 5,893,489 to Giarrante, U.S. Des. 329,981 to Card and U.S. Des. 315,781 to Hart, et al. Although these patents show a lid that facilitates pouring a liquid from the container through the spout, as opposed to pouring directly over the edge of the container, they do not show use of the lids to beneficially transfer a viscous fluid from one container to another.

Although the prior art does disclose various systems for transferring a viscous liquid from a first container to a second container, these systems are not commonly utilized or available despite the large number of people who could benefit from such systems. For instance, painters who use large quantities of paint could significantly reduce their costs if they could recover much of the paint that is currently lost. Restaurants and the like could benefit by having an easier and more convenient to use system of transferring condiments such as ketchup and mustard from nearly empty containers to a second container that is more full, thereby reducing product loss and customer frustration with having to wait on the slow movement of product out of a mostly empty container. Many of the present systems for transferring viscous liquids from one container to another do not work well for containers having different sizes and shapes of openings. In fact, many of the prior art devices are configured for specific containers and, therefore, can only be used with those containers. Another problem with some of the prior art viscous liquid transfer systems is that the transfer of liquid results in some of the liquid spilling on the outside walls of the container receiving the viscous liquid.

What is needed, therefore, is an improved system for transferring a viscous liquid from a first container to a second container that allows the user to substantially remove and recover all of the viscous liquid in the first container. Such a system should be configured to transfer the viscous liquid from the first container to the second container without spilling the liquid, damaging either of the containers or requiring permanent modification to either container. The preferred system should be configured to transfer viscous liquid between different sizes of containers and containers that have different sized and/or configured openings. Preferably, such a system should be easy to use, require little or no input by the user while the liquid is being transferred and have components that are relatively inexpensive to manufacture so as to reduce the cost of such a system.

SUMMARY OF THE INVENTION

The system for transferring a viscous liquid between containers of the present invention provides the benefits and solves the problems identified above. That is to say, the present invention discloses a system that facilitates transferring a viscous liquid from a first container, which will typically be nearly empty of such liquid, to a second container for use and/or storage of the viscous liquid in the second container. The system of the present invention allows the user to substantially remove and recover all of the viscous liquid from the first container without requiring any ongoing effort by the user while the system is transferring the viscous liquid. The system of the present invention transfers the viscous liquid from the first container without spilling the liquid, damaging either container or requiring any modification to either container. In the preferred configuration of the present invention, the system allows the user to transfer the viscous liquid between different sized containers and containers having different sized and/or shaped openings. The preferred system is easy to use and can be manufactured out of materials and in a manner such that the components of the system are relatively inexpensive to manufacture. In one embodiment, the system of the present invention is specially configured for use with paint cans and similarly configured containers. In another embodiment, the system is configured for use with bottles.

In one general aspect of the present invention, the system for transferring a viscous liquid comprises a first container, a first transfer lid on the first container, a second container, a second transfer lid on the second container and a transfer adapter interconnecting the two transfer lids. The first transfer lid has a downwardly disposed outlet spout which defines a discharge opening, a peripherally disposed edge wall that defines a first container receiving opening and a sidewall that interconnects the edge wall and the outlet spout. The edge wall is sized and configured to be received over a peripherally disposed edge of the first container with the opening defined by the edge being disposed above the outlet spout when the first container is inverted and the upper end of the first container is received into the first container receiving opening. The second transfer lid has an upwardly disposed inlet spout that defines an inlet opening, a peripherally disposed edge wall that defines a second container receiving opening and a sidewall that interconnects the edge wall and the inlet spout. The edge wall is sized and configured to be received over a peripherally disposed edge of the second container with the opening that is defined by the edge being disposed below the inlet spout when the second container is placed in an upright position with the second container receiving opening placed on the upper end of the second container. The transfer adapter, which interconnects the first transfer lid and the second transfer lid, has a tubular shaped upper section that is sized and configured to receive the outlet spout of the first transfer lid and a tubular shaped lower section that is sized and configured to be received in the inlet spout of the second transfer lid.

In another general aspect of the present invention, the system for transferring a viscous liquid comprises a bottle connector, a transfer lid and a transfer adapter that are configured to transfer the liquid between a bottle and a container. The bottle connector has a bottle engaging section that is configured to engage an open end of the bottle and a connection section having a plurality of outwardly extending members. The transfer lid has a spout, a peripherally disposed edge wall defining a container receiving opening configured to receive the upper end of the container and a sidewall interconnecting the edge wall and the spout. The spout defines an inlet when the container is in an upright position and an outlet when the container is in an inverted position. The edge wall is sized and configured to be received over the edge of the container. The transfer adapter, which interconnects the bottle connector and the transfer lid, has a connection section with a plurality of outwardly extending members configured to be placed in interlocking relation with the outwardly extending members of the connection section of the bottle connector and a tubular shaped container engaging section sized and configured to be received in the spout of the transfer lid when the container is in the upright position and to receive the spout of the transfer lid when the container is in the inverted position, depending whether the liquid is being transferred from the bottle to the container or from the container to the bottle.

In yet another general aspect of the present invention, the system for transferring a viscous liquid comprises a first bottle connector and a second bottle connector that are cooperatively configured to transfer the liquid from a first bottle to a second bottle. The first bottle connector has a first bottle engaging section that is configured to engage an open end of the first bottle and a first connection section that has a plurality of outwardly extending members. The second bottle connector has a second bottle engaging section configured to engage an open end of the second bottle and a second connection section having a plurality of outwardly extending members that are configured to be placed in interlocking relation with the outwardly extending members of the first connection section with the open end of the first bottle disposed in an inverted position above the open end of the second bottle. In a preferred embodiment, each of first and second bottle engaging sections have a threaded inner wall configured to threadably engage the open end of their respective bottles.

Accordingly, the primary aspect of the present invention is to provide a system for transferring a viscous liquid between containers that has the advantages discussed above and which overcomes the disadvantages and limitations associated with prior art devices and systems for transferring viscous liquids between containers.

It is an important aspect of the present invention to provide a system for transferring a viscous liquid between containers that substantially transfers all of the viscous liquid in a first container to a second container without requiring ongoing effort or involvement by the user while the liquid is being transferred.

It is an important aspect of the present invention to provide a system for transferring a viscous liquid between containers that can be utilized to transfer the viscous liquid between different sized containers and/or containers that have different sized and/or shaped openings.

It is an important aspect of the present invention to provide a system for transferring a viscous liquid from a first container to a second container that prevents spillage of the liquid during the transfer process, does not damage either container and does not require permanent modification to either container.

It is an important aspect of the present invention to provide a system for transferring a viscous liquid between containers that can be utilized with containers having different types or styles of container rims and/or openings, such as those which are threaded, non-threaded or have other variations, Another important aspect of the present invention is to provide a system for transferring a viscous liquid between containers that is easy to use, adaptable to a wide range of container sizes and shapes and has components which are relatively inexpensive to manufacture.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain configurations for the containers and the corresponding configuration for the components of a preferred embodiment of the system, those skilled in the art will readily understand that this is merely for purposes of simplifying this disclosure and that the present invention is not so limited.

Figure 1:
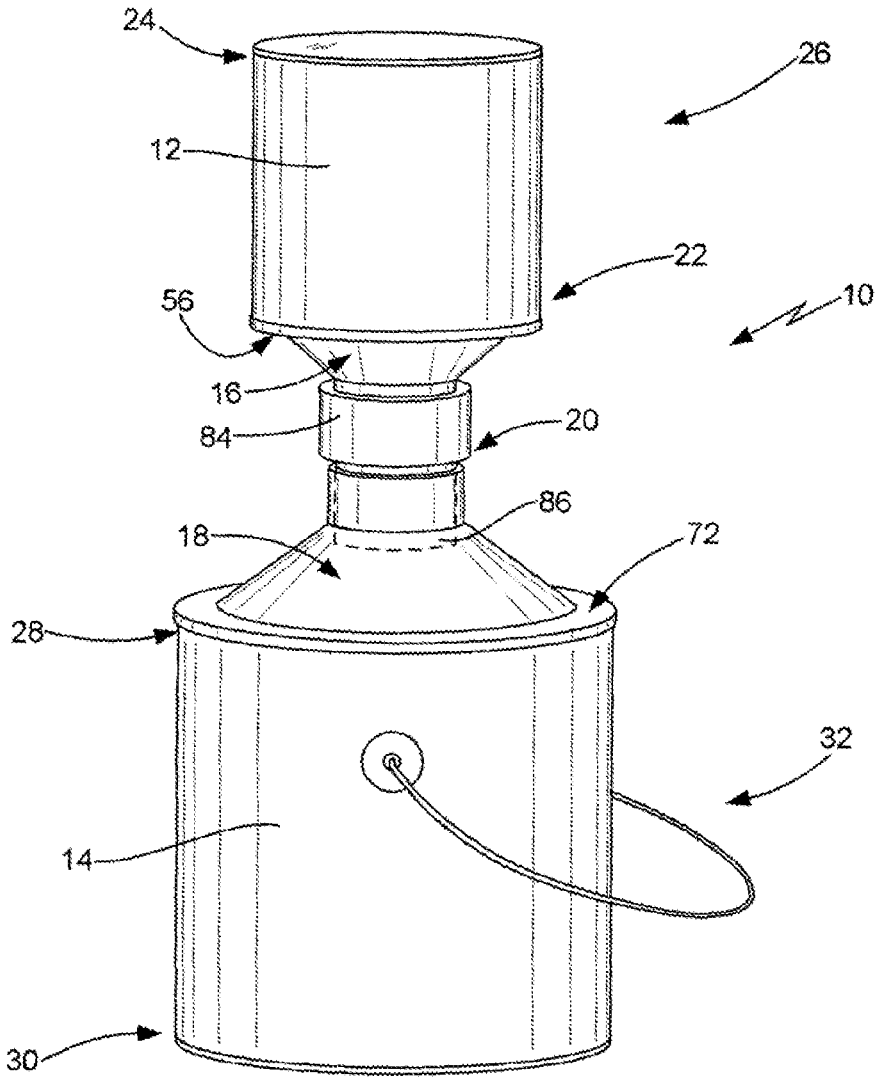
FIG. 1 is a side perspective view of the system for transferring a viscous liquid between containers of the present invention shown in use to transfer such liquid from a first container to a second container.
Figure 16:
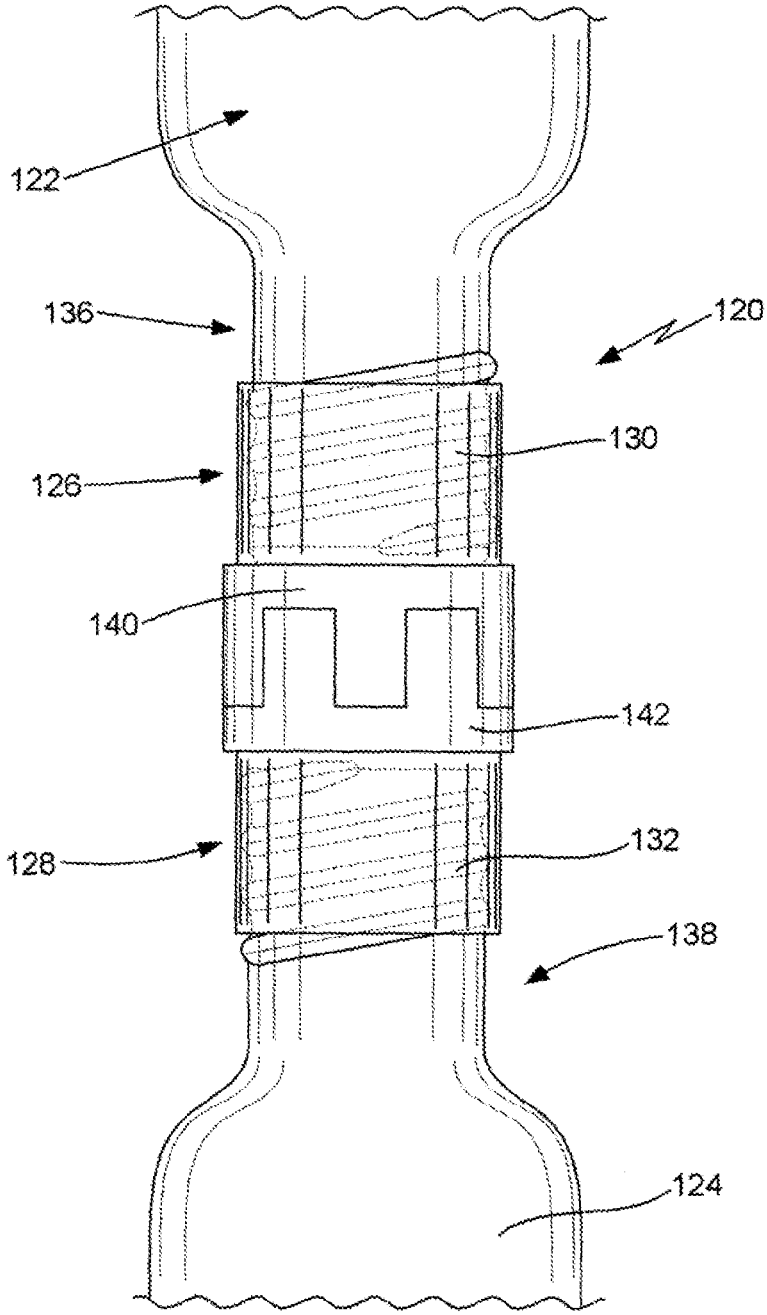
FIG. 16 is a side view of an alternative configuration of a system for transferring a viscous liquid between containers utilized to transfer such liquids between two bottles shown in use to transfer viscous liquids from a first bottle to a second bottle.

A system for transferring viscous liquids between containers that is configured pursuant to a preferred embodiment of the present invention is shown generally as 10 in FIGS. 1 and 120 in FIG. 16. As set forth in more detail below, the system 10 generally comprises a first container 12 having viscous liquid to be transferred, a second container 14 for receiving the transferred viscous liquid, a first transfer lid 16 that attaches to the first container 12, a second transfer lid 18 that attaches to the second container 14 and a transfer adapter 20 that connects the first transfer lid 16 and the second transfer lid 18, as best shown in FIG. 1. In FIG. 1, the system 10 is shown with first 12 and second 14 containers being of the type typically utilized as paint cans for holding various quantities of paint, as the viscous liquid. One common use of the system 10, as shown in FIG. 1, will be to transfer paint from a container that is partially or nearly completely empty of paint so the user of system 10 can recover and remove the paint that remains behind to avoid wasting the paint and having to be concerned with disposal issues. The system 10 of the present invention, however, is not so limited. For instance, system 10 can be utilized by a user to transfer nearly full paint cans into an empty paint can so that he or she may combine a plurality of smaller cans into one larger can. Alternatively, the positioning of the two containers 12/14 can be reversed so the user can transfer paint from an "empty" or near empty larger paint can (container 14) to a smaller, more convenient to use and/or store paint can (container 12). Likewise, the two containers 12/14 can be the same size. In any of the above-described uses, the first transfer lid 16 and the second transfer lid 18 are sized and configured to attach, as set forth below, to the top of the respective containers 12/14.

In addition to use of the system 10 of the present invention for transferring paint between paint cans, the user can utilize system 10 to transfer virtually any viscous liquid from a first container 12 to a second container 14. Any such containers 12/14 can be of any shape and size, as long as the first 16 and second 18 transfer lids are correspondingly configured. For instance, if first container 12 has a square cross-section, then the first transfer lid 16 should be sized and shaped to fit that cross-section profile and if the second container 14 has an oval cross-section, then the second transfer lid 18 should be sized and configured to fit that profile.

Figure 3:
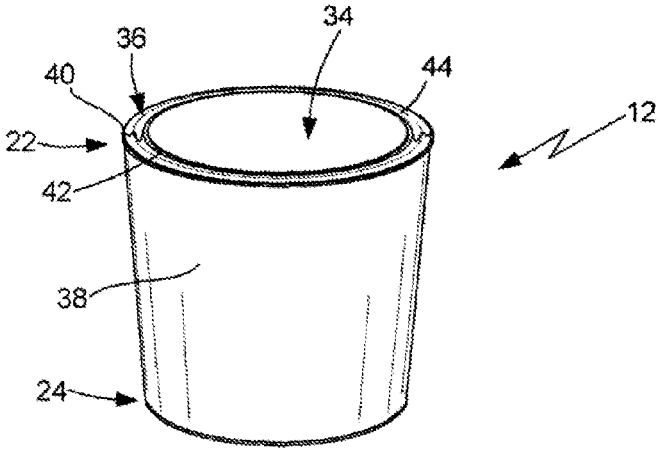
FIG. 3 (PRIOR ART)
FIG. 3 is a top perspective view of the first container of the system of FIG. 1 showing the inner and outer lips and channel thereof.
Figure 4:
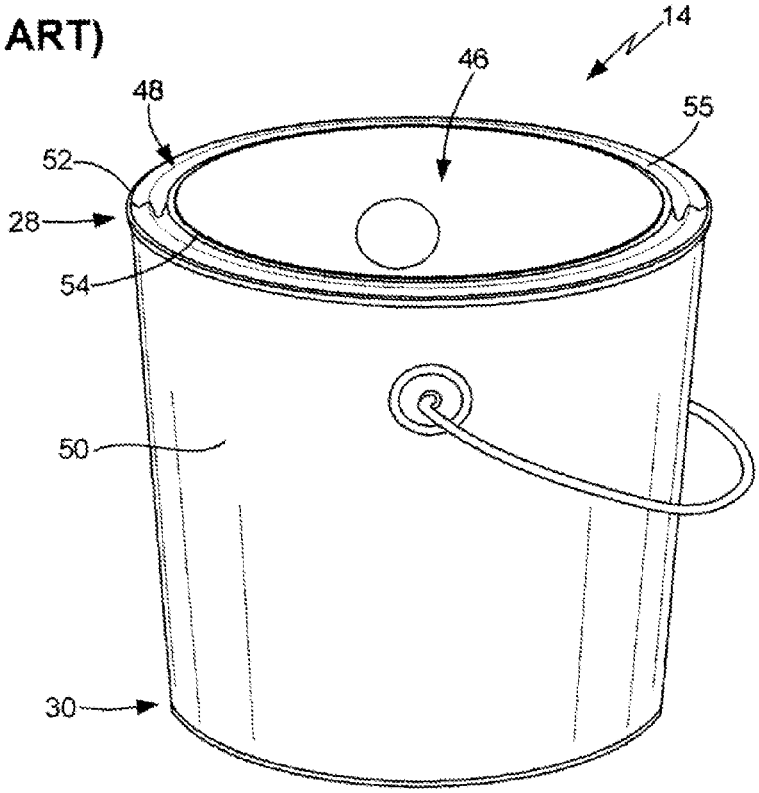
FIG. 4 (PRIOR ART)
FIG. 4 is a top perspective view of the second container of the system of FIG. 1 showing the inner and outer lips and channel thereof.
Figure 5:
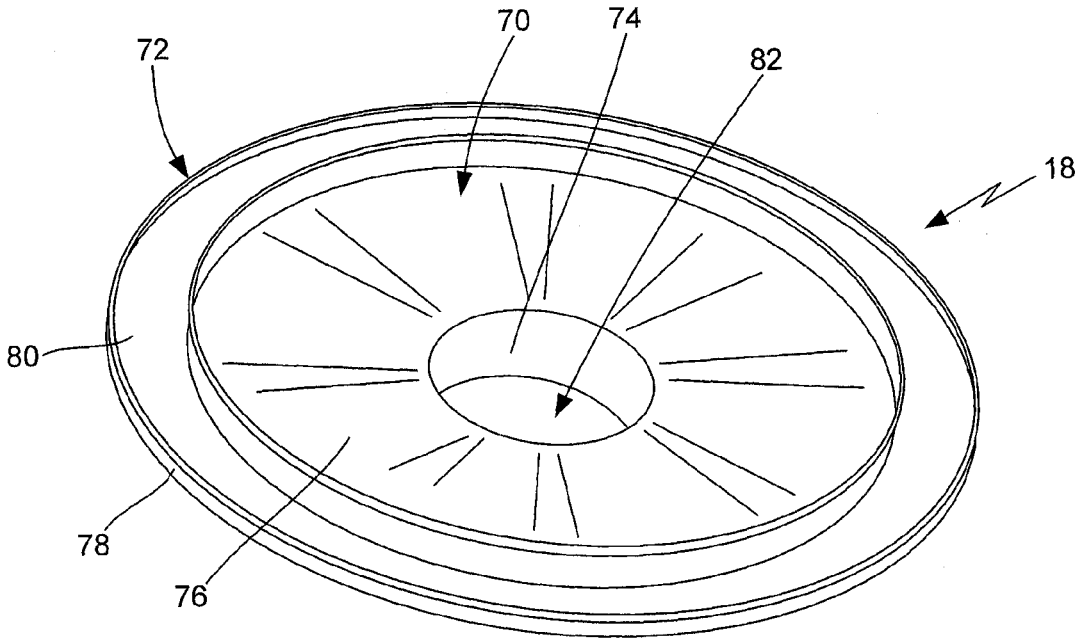
FIG. 5 is a bottom perspective view of the second transfer lid of the system of FIG. 1.

The first container 12 has an upper end 22 and a lower end 24. In the embodiment shown in FIG. 1, the first container 12 is in an inverted position 26 with the upper end 22 thereof directed downward to facilitate gravity flow of the viscous liquid toward the second container 14. As will be readily understood by those skilled in the art, the terms upper end 22 and lower end 24 are used to describe the respective ends of first container 12 when it is disposed in its normal upright use position (shown in FIG. 3). The second container 14 has an upper end 28 and a lower end 30. In the embodiment shown in FIG. 1, the second container 14 is in an upright position 32 with the upper end 28 thereof directed upward to facilitate the flow of the viscous liquid into the second container 14 from the first container through the first transfer lid 16, transfer adapter 20 and the second transfer lid 18, as described in more detail below. As shown in FIG. 3, the first container 12 has an opening 34 defined by a peripherally disposed edge 36 at the upper end 22 thereof with a sidewall 38 interconnecting the upper end 22 and the lower end 24 of first container 12. The edge 36 of the typical paint can, as first container 12, has an outer lip 40 and an inner lip 42 that define a channel 44 therebetween in which the standard paint can lid is normally received when the paint can is closed. As shown in FIG. 4, the second container 14 has an opening 46 defined by a peripherally disposed edge 48 at the upper end 28 thereof with a sidewall 50 interconnecting the upper end 28 and the lower end 30 of second container 14. The edge 48 of a typical paint can, as second container 14, has an outer lip 52 and an inner lip 54 that define a channel 55 therebetween in which the standard paint can lid is normally received when the paint can is closed.

Figure 2:
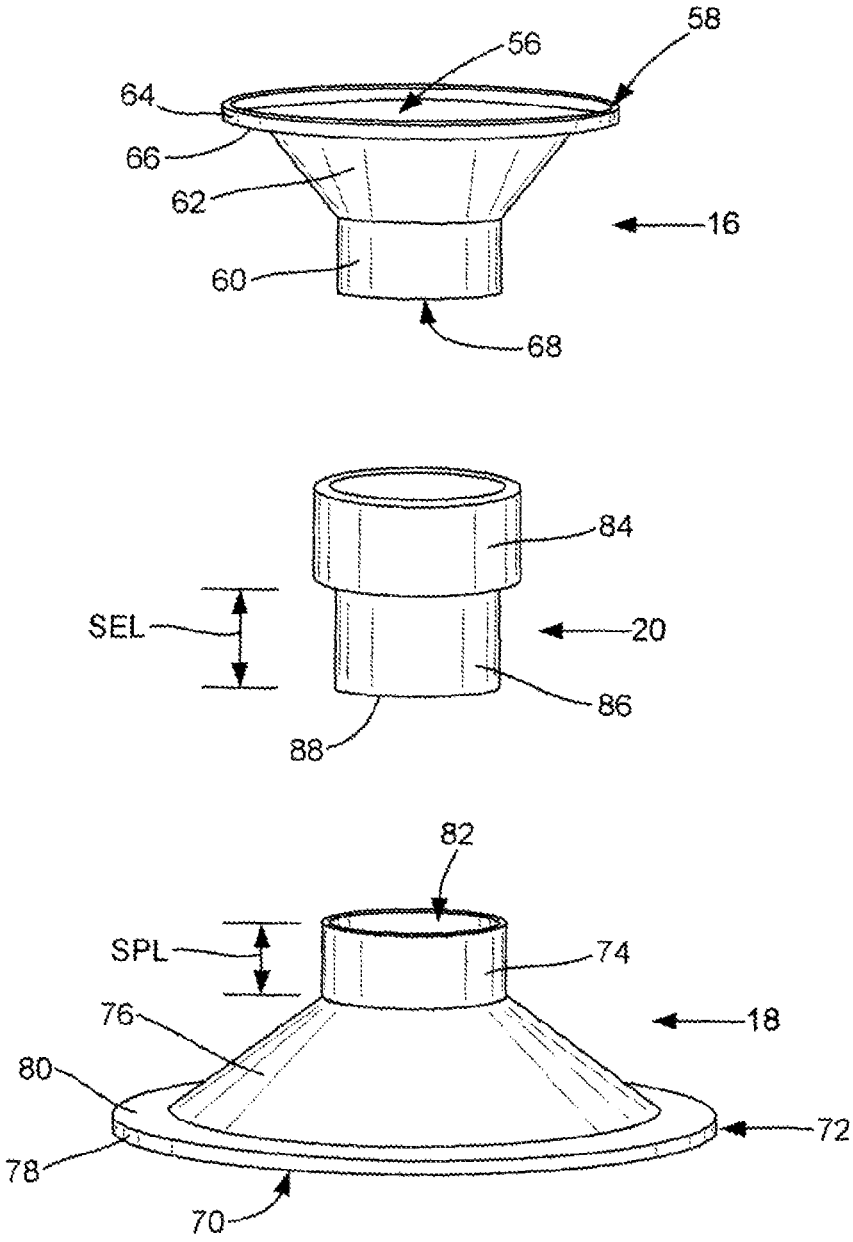
FIG. 2 is a side view of the components of the system of FIG. 1.

In the preferred embodiment, first transfer lid 16 has a first container receiving opening 56 with a peripherally disposed flange 58, a downwardly disposed outlet spout 60 and a sidewall 62 interconnecting the flange 58 and the outlet spout 60, as best shown in FIG. 2. A preferred flange 58 comprises an upwardly disposed, peripheral edge wall 64 and a substantially horizontal bottom wall 66, the inner edge of which connects to the sidewall 62. In this embodiment, the first container receiving opening 56 is defined by the edge wall 64 of flange 58. The outlet spout 60 is tubular to define a discharge opening 68 at the bottom of outlet spout 60. In an alternative embodiment, the flange 58 does not have bottom wall 66 such that the sidewall 62 connects directly to the edge wall 64 to interconnect outlet spout 60 directly with edge wall 64. In either configuration, the edge wall 64 is sized and configured to be received over the edge 36 of the first container 12. Preferably, edge wall 64 is somewhat snugly received over edge 36 to prevent slippage and/or spillage of the viscous liquid during the transfer process. In the embodiment shown, flange 58 is in abutting relation with the edge 36 of first container 12 and edge wall 64 is in abutting relation with the sidewall 38 of first container 12 when the upper end 22 of the first container 12 is received into the first container receiving opening 56 during use of system 10 to transfer viscous fluid from first container 12 to second container 14, as shown in FIG. 1.

In the preferred embodiment, second transfer lid 18 has a second container receiving opening 70 having a peripherally disposed flange 72, an upwardly disposed inlet spout 74 and a sidewall 76 interconnecting the flange 72 and the inlet spout 74, as best shown in FIG. 2. A preferred flange 72 comprises a downwardly disposed, peripheral edge wall 78 and a substantially horizontal top wall 80, the inner edge of which connects to the sidewall 76. In this embodiment, the second container receiving opening 70 is defined by edge wall 78 of flange 72. The inlet spout 74 is tubular to define an inlet opening 82 at the top of inlet spout 74. In an alternative embodiment, the flange 72 does not have top wall 80 such that the sidewall 76 connects directly to the edge wall 78 to interconnect inlet spout 74 directly with edge wall 78. In either configuration, the edge wall 78 is sized and configured to be received over the edge 48 of the second container 14. Preferably, the edge wall 78 is somewhat snugly received over edge 48 to prevent slippage and/or spillage of the viscous liquid during the transfer process. In the embodiment shown, flange 72 is in abutting relation with the edge 48 of second container 14 and edge wall 78 is in abutting relation with the sidewall 50 of second container 14 when the second container receiving opening 70 is placed over the upper end 28 of the second container 14 during use of system 10 to transfer viscous fluid from first container 12 to second container 14, as shown in FIG. 1.

Figure 6:
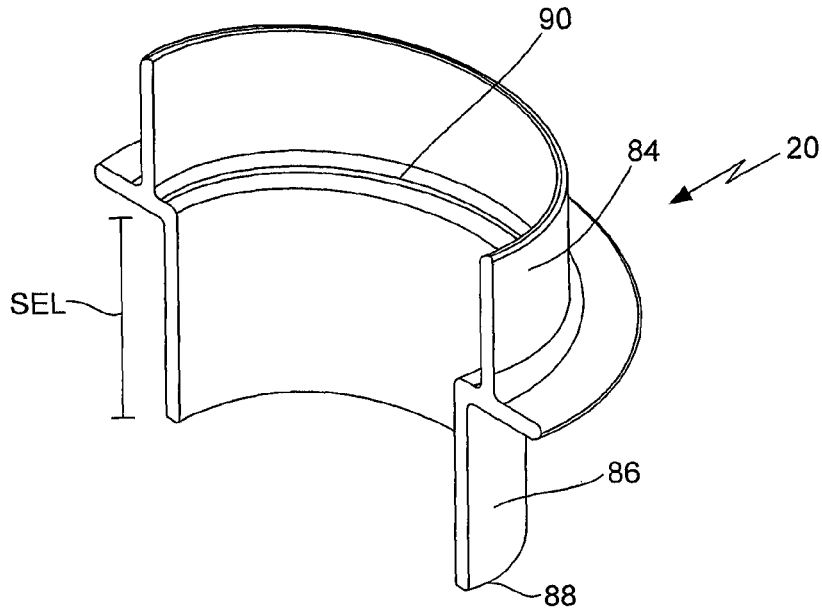
FIG. 6 is a cross-sectional side perspective view of an alternative configuration for the transfer adapter of the system of FIG. 1.
Figure 7:
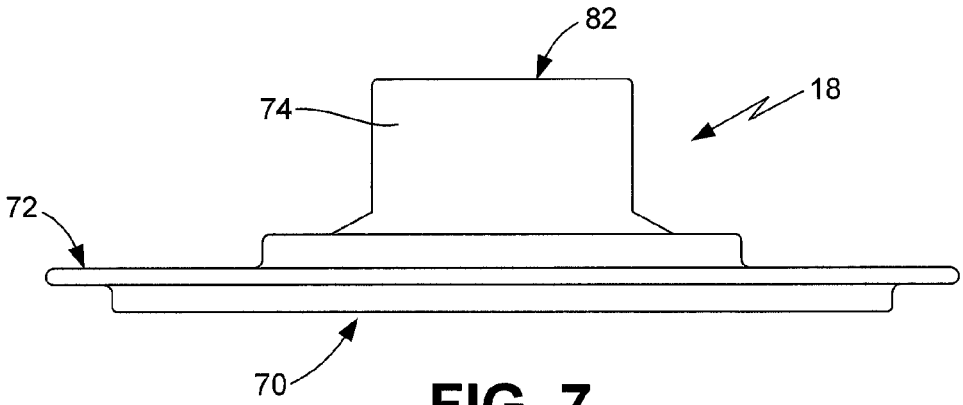
FIG. 7 is a side view of an alternative configuration of the transfer lids utilized with the system of the present invention.
Figure 8:
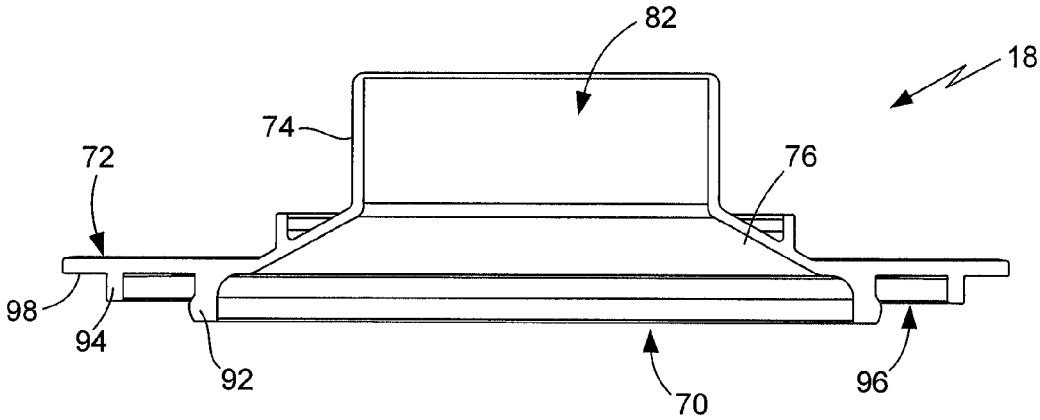
FIG. 8 is cross-sectional side view of the transfer lid of FIG. 7 taken through lines 8-8 of FIG. 7.
Figure 9:
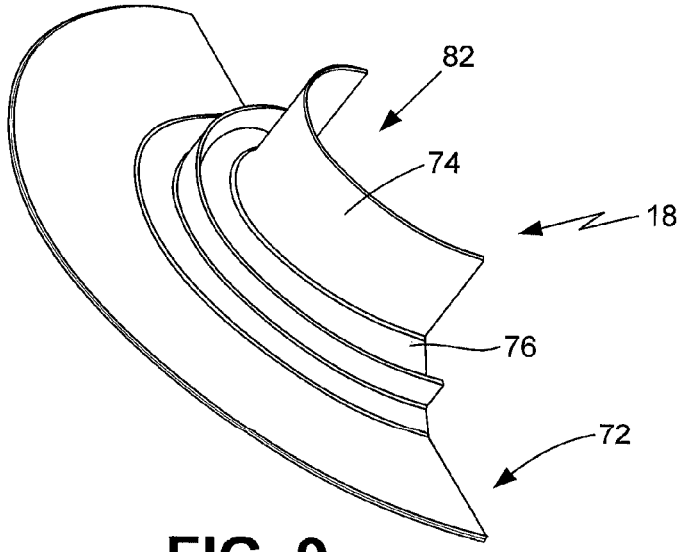
FIG. 9 is a top perspective view of the transfer lid of FIG. 8.
Figure 10:
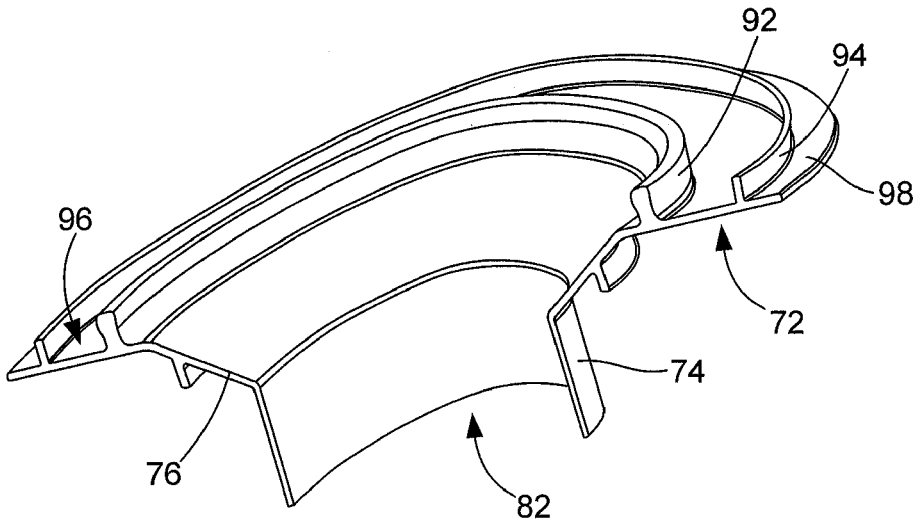
FIG. 10 is a bottom perspective view of the transfer lid of FIG. 8.

As set forth above, the system 10 of the present invention also comprises a transfer adapter 20 that interconnects the first transfer lid 16 and the second transfer lid 18, as shown in FIG. 1. The transfer adapter 20 has a tubular shaped upper section 84 that is sized and configured to receive the outlet spout 60 of the first transfer lid 16 and a tubular shaped lower section 86 that is sized and configured to be received in the inlet spout 74 of the second transfer lid 18, as best shown in FIGS. 1, 2 and 6. Preferably, the outlet spout 60 of first transfer lid 16 is snugly received in upper section 84 of transfer adapter 20 and the lower section 86 is snugly received in the inlet spout 74 of the second transfer lid 18 to provide sufficient support for the first container 12 as the viscous fluid transfers to second container 14 during use, as shown in FIG. 1. In a preferred embodiment, the lower section 86 of transfer adapter 20 has a section length SEL that is greater than the spout length SPL, as shown in FIG. 2, so the lower edge 88 of lower section 86 extends below the intersection of the spout 74 and the sidewall 76 of the second transfer lid 18, as best shown in FIG. 1, to prevent any of the viscous liquid from flowing or dripping onto the sidewall 76 of the second transfer lid 18 during the transfer of the liquid. This provides a drip edge (lower edge 88) that has the benefit of significantly reducing cleanup time and effort after the transfer of the viscous liquid takes place. The alternative configuration of the transfer adapter 20 in FIG. 6, taken in cross-section through transfer adapter 20, shows the inner lip 90 against which the lower end of the outlet spout 60 abuts when the first transfer lid 16 is connected to transfer adapter 20, as shown in FIG. 1, during use.

FIGS. 7 through 10 show an alternative configuration for the first 16 and second 18 transfer lids of the system 10 of the present invention. As set forth above with regard to the previous embodiment, typically both lids 16/18 will be configured the same except as regards to the size and shape as needed to correspond to the containers 12/14. For ease of discussion and illustration, the features of this embodiment are described and show with regard to the second transfer lid 18 and the second container 14, although these features will also be applicable to the first transfer lid 16 and the first container 12. This embodiment shows use of a universally sized transfer adapter 20 that can be utilized for more than one size of container 12. Instead of flange 72 having edge wall 78, the flange 72 comprises one or more downwardly projecting rims, such as first rim 92 and second rim 94, a channel 96 between the rims 92/94 and an extension section 98. For one sized container 14, the outer lip 52 of the second container 14 will abut first rim 92 when draining the viscous fluid into the second container 14. For a different sized container 14 (i.e., having a larger diameter opening 46), outer lip 52 of second container 14 will abut second rim 94 and/or the inner lip 54 thereof will abut the first rim 92, with edge 48 disposed in channel 96 of the second transfer lid 18. For an even larger sized container 14, the inner lip 42 will abut the second rim 94 and the extension section 98 will be over edge 48. As will be readily apparent to those skilled in the art, the specific sizes and relationships between the first rim 92, second rim 94 and extension section 98 will determine what sizes of container 14 the second transfer lid 18 will fit. Likewise, the number of rims 92/94 will be determinative of the number of different sized containers 14 that the second transfer lid 18 will fit.

Figure 11:
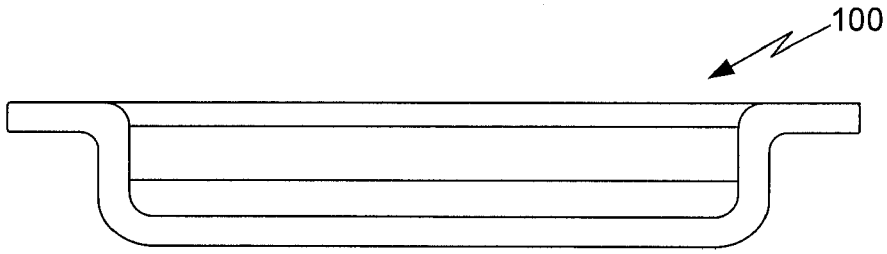
FIG. 11 is a cross-sectional side view of cap that can be utilized with the system of the present invention.
Figure 12:
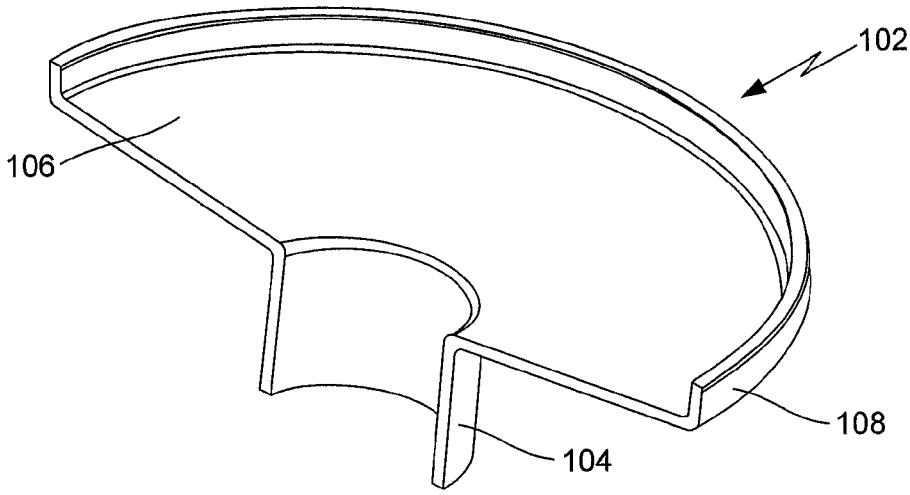
FIG. 12 is a cross-sectional side perspective view of a brush holder that can be utilized with the system of the present invention.
Figure 13:
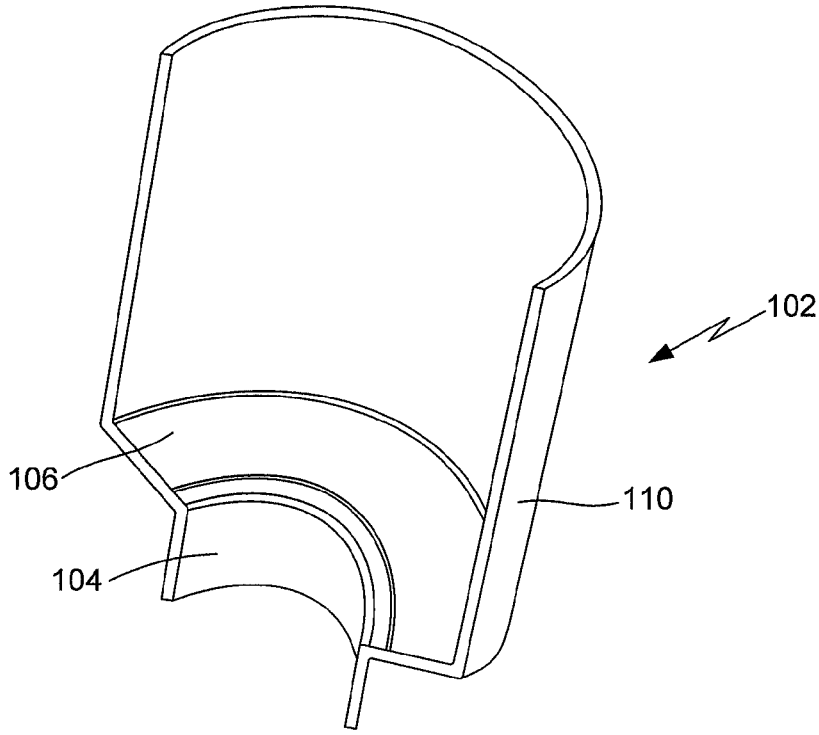
FIG. 13 is a cross-sectional side perspective view of an alternative embodiment of a brush holder that can be utilized with the system of the present invention.
Figure 14:
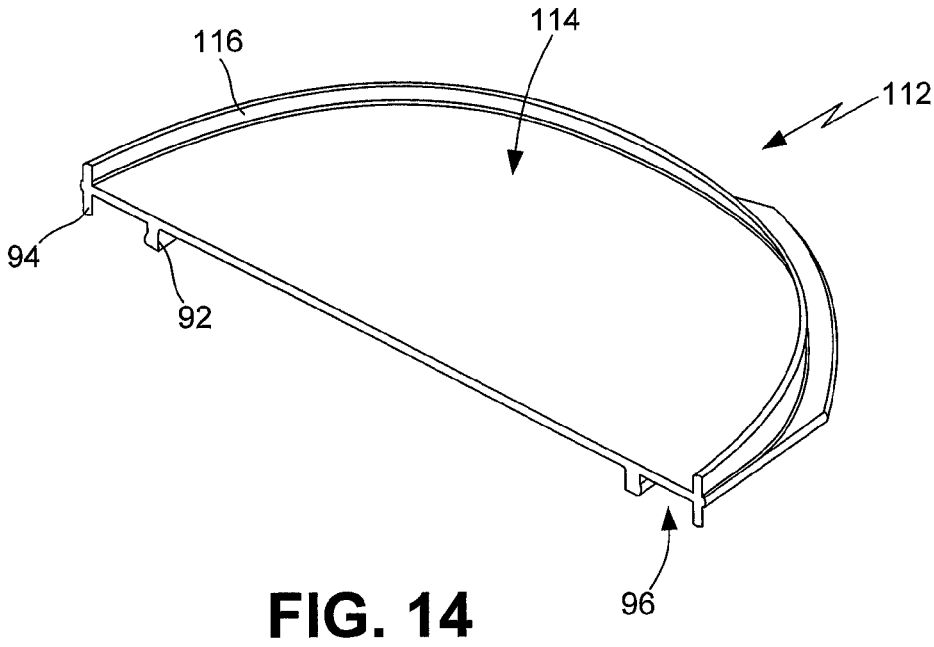
FIG. 14 is a cross-sectional top perspective view of a flat lid utilized for stacking containers on top of each other.
Figure 15:
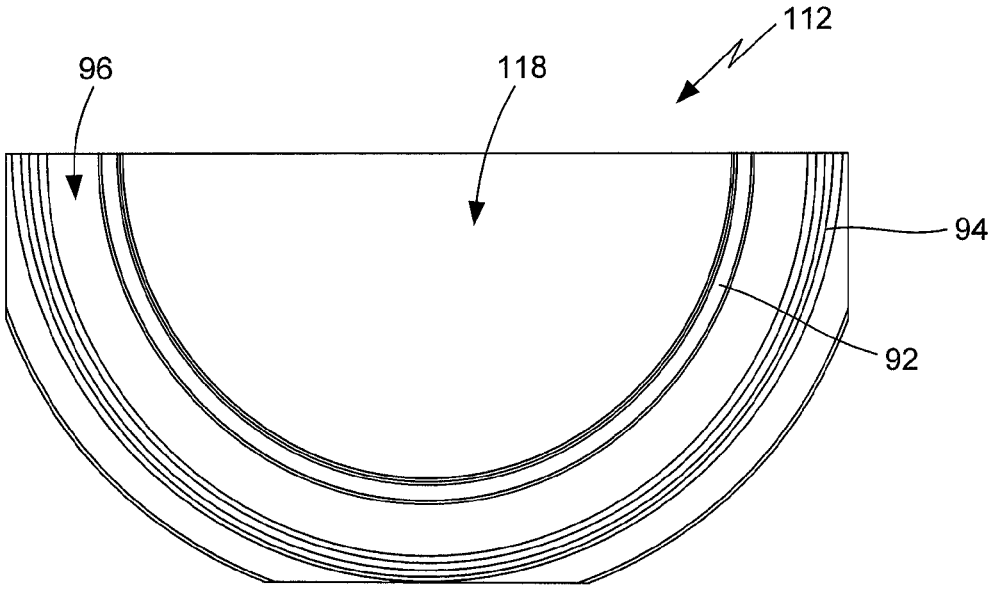
FIG. 15 is a bottom view of the flat lid of FIG. 14.

FIGS. 11 through 15 show a variety of accessories that can be used with the system 10 of the present invention. FIG. 11 is a cross-sectional view of a cap 100 that can be used to close the inlet opening 82 of the inlet spout 74 of the second transfer lid 18 so the viscous fluid transferred into second container 14 can be stored with the second transfer lid 18 thereon. If desired, the cap 100 can also be utilized to close the discharge opening 68 of the outlet spout 60 of the first transfer lid 16 when storing first container 12. FIGS. 12 and 13 show different configurations for a brush tray 102 that can be utilized with the system 10 of the present invention. The brush tray 102 comprises a spout 104 that fits within the discharge opening 68 of first transfer lid 16 and/or the inlet opening 82 of the second transfer lid 18 so the user can lay his or her brush on or against the brush support wall 106. The embodiment of FIG. 12 shows a generally flat brush tray 102 having a peripherally disposed rim 108 and the embodiment of FIG. 13 shows a generally vertical brush tray 102 having a peripherally disposed vertical wall 110. In either embodiment, the brush tray 102 can be used to support a brush while the user is painting. If desired, the user can also utilize the fist transfer lid 16 and/or the second transfer lid 18 to more efficiently and with less mess pour paint from the first container 12 or second container 14 through their respective spouts 72/74. If desired, a stacking or flat lid 112, shown in FIGS. 14 and 15, can also be utilized with system 10 of the present invention to facilitate stacking the bottom of one container, such as first container 12, on the top of another container, such as second container 14. Such a flat lid 112 should be sized and configured or the size of containers 12/14 with which it will be used. In a preferred embodiment, the upper side of flat lid 112 comprises a substantially flat upper surface 114 having an upwardly disposed engaging rim 116 that is sized and configured to receive the lower end, such as lower end 24 of the first container 12 or the lower end 30 of second container 14, inside the area defined by the engaging rim 116. Preferably, the engaging rim 116 is sized to snugly engage the lower end 24/30 of the container 12/14 to support the container 12/14 that is stacked on top. As shown in FIGS. 14 and 15, the lower side of flat lid 112 is configured substantially the same as the bottom portions of transfer lids 16/18, except that it has a substantially flat lower surface 118 with no spouts 60/74 or other openings. Specifically, the flat lid 112 has a first rim 92 and a second rim 94 that define a channel 96 therebetween which is sized and configured to be placed over the edge 36/48 of the container 12/14 that is on the bottom of the stacked containers. In addition to allowing the containers 12/14 to be more easily stacked, the stacking tray 112 seals the viscous liquid inside the containers 12/14 to prevent spillage and to preserve, as much as possible depending on the liquid, the viscous liquid for later use.

Another advantage of the transfer lids 16/18 utilized with the system 10 of the present invention is that the transfer lids 16/18 also facilitate pouring the viscous liquid directly from the container 12/14 without spilling the viscous liquid onto a surface, such as the ground, floor, patio or the like, on which the container 12/14 is placed and without causing the viscous liquid to spill over the sidewalls 38/50 of the containers 12/14, which would then drip onto the surface. As such, the user can easily pour the viscous liquid into a paint tray, cup or directly onto a surface which is to be covered with the liquid, such as a roof with roof tars and the like. Because the viscous liquid is contained within the container 12/14, there will not be a need to place a dropcloth or other protective layer under a can which had some of the liquid poured therefrom. In addition, the use of the transfer lids 16/18 on containers 12/14 during use significantly reduces or may even prevent viscous liquid from spilling out of the container 12/14 if it is tipped over while the user is painting, tarring or otherwise using the viscous liquid. Placement of the cap 100 on the transfer lid 16/18 when viscous liquid is not being transferred will also reduce the amount or likelihood of spillage. The use of cap 100 on the transfer lid 16/18 also contains the vapors, some of which may be noxious, inside the container 12/14 and prevents air from contaminating the viscous liquid while it is inside the container 12/14. Use of transfer lid 16/18 and cap 100 will also help prevent degradation of the environment due to the escape of the viscous liquid fumes from the container 12/14. Another advantage of the system 10 of the present invention is that the transfer lids 16/18 can be placed on containers 12/14 without the need for any tools, such as hammers, screwdrivers, can pry openers or other devices commonly utilized with opening sealed cans for access to the viscous liquid and sealably closing the can when the user is finished using the liquid. Yet another advantage of the transfer lids 12/14 of the system 10 of the present invention is that they allow full use of the wire handle, such as is typically found on paint cans and the like (as shown in FIGS. 1 and 4), even when they are positioned on the container 12/14. Prior art lids generally do not allow use of this handle when installed on the container.

Figure 17:
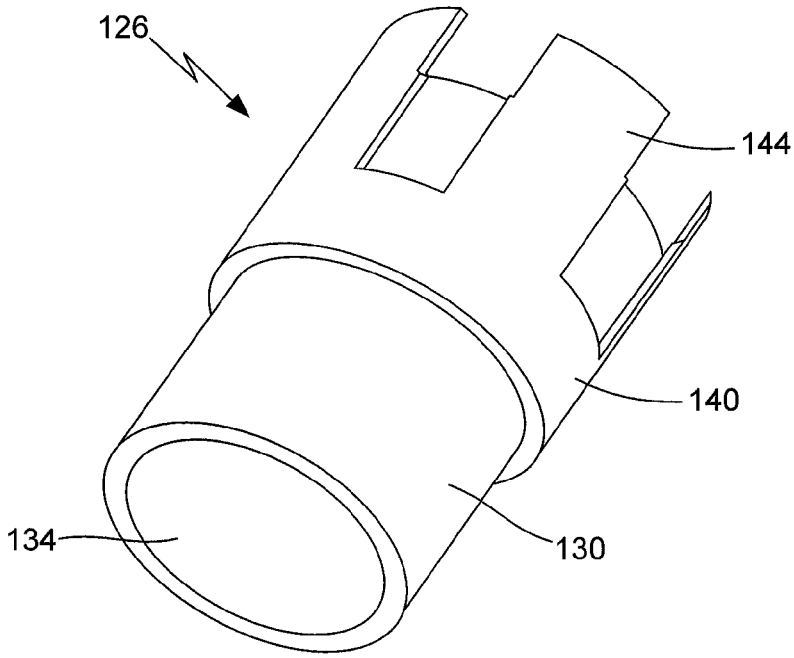
FIG. 17 is a side perspective view of the first connector utilized with the system of FIG. 16.
Figure 18:
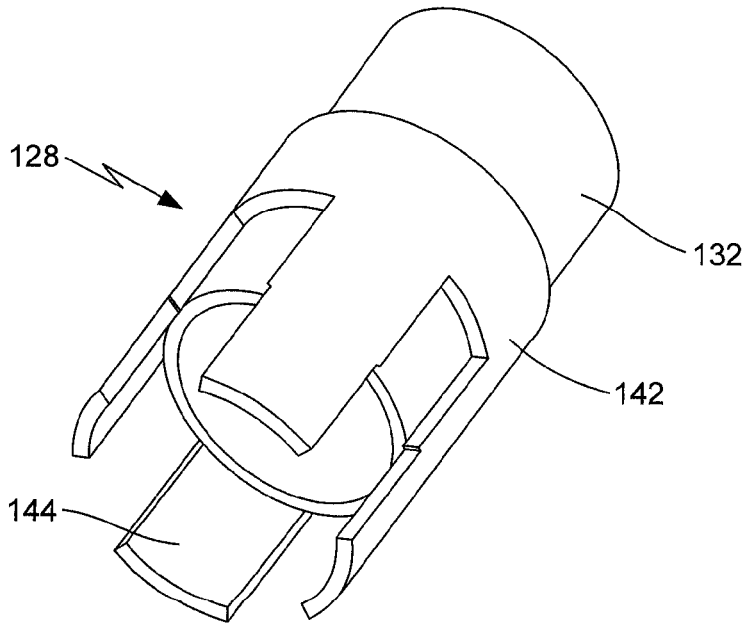
FIG. 18 is a side perspective view of the second connector utilized with the system of FIG. 16.

FIGS. 16 through 18 show an alternative embodiment of the system of the present invention, identified as 120 in FIG. 16, that is specially configured for use with transferring a viscous fluid from a first bottle 122 to a second bottle 124. In this embodiment, the system 120 comprises a first bottle connector 126 that engages the first bottle 122 and a second bottle connector 128 that engages the second bottle 124, as shown in FIG. 16. As set forth in more detail below, the system 120 is configured with a genderless connection that joins the first bottle connector 126 and the second bottle connector 128 together in an interlocking relationship. Each of the bottle connectors 126/128 have a bottle engaging section, shown as first bottle engaging section 130 for first bottle connector 126 and second bottle engaging section 132 for second bottle connector 128 in FIGS. 16 through 16. The bottle engaging sections 130/132 have an inner wall 134 that is configured to engage a bottle, such as bottles 122/124. In some embodiments, the inner wall will be threaded so as to threadably engage, as shown in FIG. 16, the open ends 136 and 138 of bottles 122/124, respectively, or be smooth to frictionally engage the open ends 136/138 of bottles 122/124. Each of the bottle connectors 126/128 have connection section, shown respectively as first connection section 140 and second connection section 142, that each comprise a plurality of outwardly extending members 144 that are peripherally disposed about the connection sections 140/142 so they may be joined in interlocking relation, as shown in FIG. 16. In this manner, the bottle connectors 126/128 do not have to be configured with correspondingly configured male and female connectors, thereby significantly reducing the cost of manufacturing the different sizes and configurations of the components of the bottle transfer system 120. Each of the outwardly extending members 144 have a notched section 146 that has a slightly offset notch that corresponds to the notched section 146 on the opposing extending members 144 of the connection sections 140/142 of the opposite bottle connectors 126/128. The notched sections 146 on the opposing, interlocking extending members 144 allow the user to slightly twist one bottle connector 126/128 relative to the other to seat the bottle connectors 126/128 so as to better engage the two bottle connectors 126/128 relative to each other and more securely interlock them so as to prevent unintended disconnect that could result in spillage of the viscous liquid.

Figure 19:
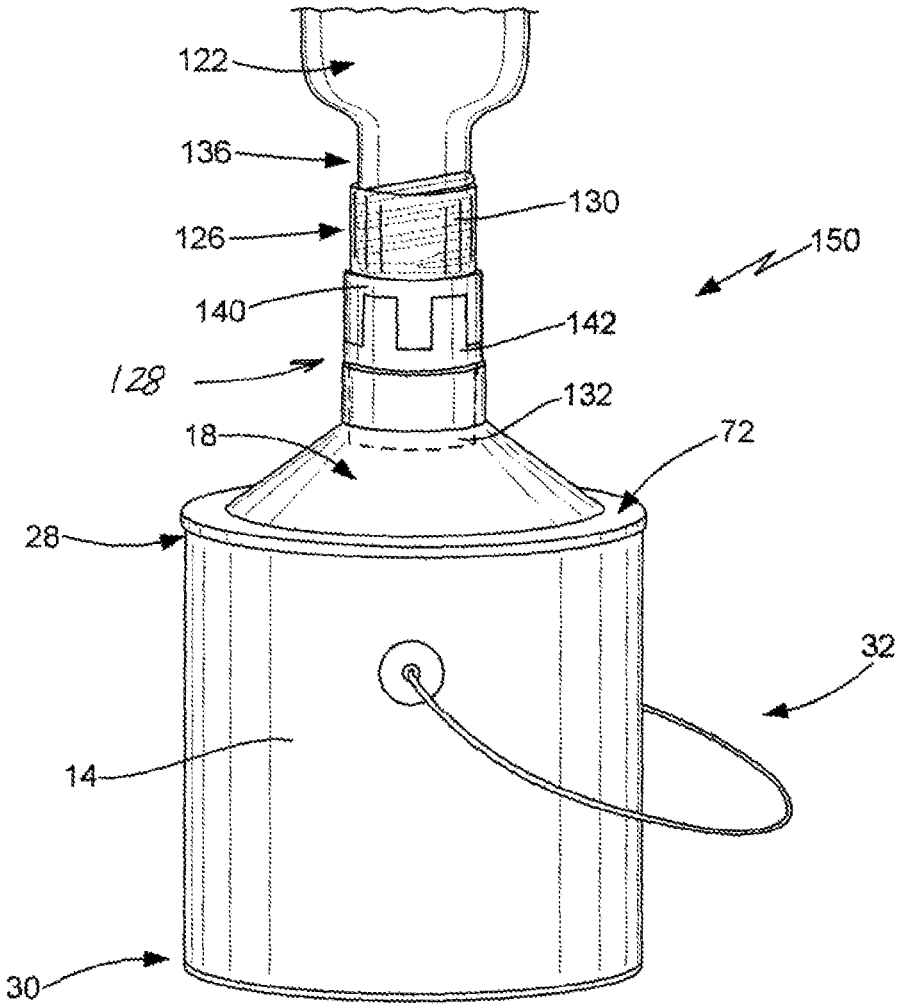
FIG. 19 is a side view of an alternative configuration of a system for transferring a viscous liquid between containers utilized to transfer such liquids between a can-like container and a bottle container shown in use to transfer a viscous liquid from a bottle to a can.

An alternative configuration of a viscous liquid transfer system, shown as 150 in FIG. 19, is utilized to transfer a viscous liquid between a bottle and a can using features of the systems described above. The embodiment shown in FIG. 19 shows transfer of a viscous liquid from a first bottle 122 to a second container 14. Those skilled in the art, however, will readily appreciate that the system 150 can also be utilized to transfer a viscous liquid from a can like container, such as 12 and 14, to a bottle like container, such as 122 and 124. In the embodiment shown, the second transfer lid 18, first bottle connector 126 and second bottle connector 128 are the same as set forth above. As such, the second transfer lid 18 attaches to the second container 14 as described above, the first bottle connector 126 attaches to the first bottle 122 as described above and the two bottle connectors 126/129 join together, by interlocking arrangement, as described above. As with the lower section 86 of transfer adapter 20, the second bottle engaging section 132 extends down below the lower end of the upwardly extending inlet spout 74 of the second transfer lid 18 to avoid dripping of the viscous liquid along the sidewall 76 of the second transfer lid 18, as shown in FIG. 18. When the container 12/14 is in its upright position 32, the tubular section 84/86 is received into spout 60/74 of the transfer lid 16/18. When the container 12/14 is in its inverted position 26, the spout 60/74 is received into the tubular section 84/86.

The components of system 10 and 120 of the present invention can be made out of a wide variety of different materials. In a preferred embodiment, however, these components are made out of plastic, composites or like materials that can be injection molded to the desired sizes and shapes. The system 10 of the present invention is utilized by attaching the first transfer lid 16 over the opening 34 of the first container 12 and attaching the second transfer lid 18 over the opening 46 of the second container 14. The lower section 86 of the transfer adapter 20 is inserted into the inlet spout 74 of the second transfer lid 18. Once the adapter 20 is secured, the second container 14 is placed in its upright position 32 with the inlet spout 74 generally directed upward and the first container 12 is placed in its inverted position 26 and the outlet spout 60 is inserted into the upper section 84 of the transfer adapter 20. Once in position, viscous liquid from the first container 12 will flow into the second container 14. The user will not have to do anything to system 10 once the liquid begins to flow into the second container 14. When the viscous liquid is removed from or substantially removed from first container 12, the user disassembles the system 10 by removing the components from the containers 12/14. For the system 120, the user will secure the first bottle connector 126 to the first bottle 122 and the second bottle connector 129 to the second bottle 124, as necessary for the type of connectors at the open ends 136/138 of the bottles 122/124, by utilizing the respective bottle engaging sections 130/132. The user will then place the first bottle 122 in an inverted position 26 and place the outwardly extending members 144 of the first connection section 140 in interlocking relation with the outwardly extending members 144 of the second connection section 142 to facilitate drainage of the viscous liquid from the first bottle 122 to the second bottle 124. When the liquid is substantially removed from the first bottle 122, the user disassembles the components of system 120.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A viscous liquid transfer system, comprising:

a first container having an opening defined by a peripherally disposed edge at an upper end of said first container;

a first transfer lid having a downwardly disposed outlet spout defining a discharge opening, a peripherally disposed edge wall defining a first container receiving opening and a sidewall interconnecting said edge wall and said outlet spout, said edge wall sized and configured to be received over said edge of said first container with said opening of said first container disposed above said outlet spout when said first container is placed in an inverted position with said upper end of said first container received into said first container receiving opening;

a second container having an opening defined by a peripherally disposed edge at an upper end of said second container;

a second transfer lid having an upwardly disposed inlet spout defining an inlet opening, a peripherally disposed edge wall defining a second container receiving opening and a sidewall interconnecting said edge wall and said inlet spout, said edge wall sized and configured to be received over said edge of said second container with said opening of said second container disposed below said inlet spout when said second container is placed in an upright position with said second container receiving opening placed on said upper end of said second container; and a transfer adapter interconnecting said first transfer lid and said second transfer lid, said transfer adapter having a tubular shaped upper section sized and configured to receive said outlet spout of said first transfer lid and a tubular shaped lower section sized and configured to be received in said inlet spout of said second transfer lid.

2. The system of claim 1, wherein said lower section of said transfer adapter has a section length and said inlet spout of said second transfer lid has a spout length which is less than said section length to extend said lower section below said inlet spout.

3. The system of claim 1, wherein said edge wall of said first transfer lid is in abutting relation with said sidewall of said first container when said first container is received into said first container receiving opening.

4. The system of claim 1, wherein said edge wall of said second transfer lid is in abutting relation with said sidewall of said second container when said second container is received into said second container receiving opening.

5. The system of claim 4, wherein said edge wall of said first transfer lid is in abutting relation with said sidewall of said first container when said first container is received into said first container receiving opening.

6. The system of claim 1, wherein said transfer adapter has an inner lip engaged by said outlet spout of said first transfer lid.

7. The system of claim 1, wherein said edge of said first container has an inner lip and an outer lip, said edge of said second container has an inner lip and an outer lip, said first transfer lid has a peripherally disposed flange defining said first container opening, said second transfer lid has a peripherally disposed flange defining said second container opening, said flange of said first transfer lid sized and configured to be received over said edge of said first container and said flange of said second transfer lid sized and configured to be received over said edge of said second container.

8. The system of claim 7, wherein said transfer adapter has an inner lip engaged by said outlet spout of said first transfer lid.

9. The system of claim 7, wherein each of said first transfer lid and said second transfer lid comprise one or more downwardly extending rims.

10. The system of claim 9, wherein said outer lip of said first container abuts one of said rims of said first transfer lid and said outer lip of said second container abuts one of said rims of said second transfer lid.

11. The system of claim 9, wherein each of said first transfer lid and said second transfer lid comprises a channel defined by a pair of adjacent rims, said edge of said first container received in said channel of said first transfer lid and said edge of said second container received in said channel of said second transfer lid.

12. The system of claim 7, wherein said lower section of said transfer adapter has a section length and said inlet spout of said second transfer lid has a spout length which is less than said section length to extend said lower section below said inlet spout.

* * * * *